US007111628B2

(12) United States Patent
Chen

(10) Patent No.: US 7,111,628 B2
(45) Date of Patent: Sep. 26, 2006

(54) HAIR COMBING APPARATUS FOR HAIR COLORING AND THE LIKE

(76) Inventor: Zhong Sheng Chen, 1206 N. Stoneman Ave., #5, Alhambra, CA (US) 91801

( * ) Notice: Subject to any disclaimer, the term of this patent is extended or adjusted under 35 U.S.C. 154(b) by 90 days.

(21) Appl. No.: 10/802,595

(22) Filed: Mar. 16, 2004

(65) Prior Publication Data

US 2004/0221863 A1 Nov. 11, 2004

Related U.S. Application Data

(60) Provisional application No. 60/468,968, filed on May 9, 2003.

(51) Int. Cl.
*A45D 24/16* (2006.01)
*A45D 19/18* (2006.01)

(52) U.S. Cl. ..... 132/120; 132/270; 132/139; 132/148

(58) Field of Classification Search ..... 132/120, 132/139, 161, 270, 148, 901
See application file for complete search history.

(56) References Cited

U.S. PATENT DOCUMENTS 302,734 A * 7/1884 Jobson ..... 132/142
1,172,544 A * 2/1916 Metzner ..... 132/120
1,272,982 A * 7/1918 Maze ..... 132/120
1,328,120 A * 1/1920 Bricker ..... 132/120
1,370,649 A * 3/1921 Hope ..... 132/120
2,185,050 A * 12/1939 Chiraello ..... 132/120
2,610,637 A * 9/1952 Fuentes ..... 132/120

* cited by examiner

*Primary Examiner*—Todd E. Manahan
*Assistant Examiner*—Rachel Running
(74) *Attorney, Agent, or Firm*—Raymond Y. Chan; David and Raymond Patent Group

(57) ABSTRACT

A hair combing apparatus, which is adapted for applying a colorant on a user's hairs, includes an elongated comb body having a handle portion and a guiding portion extended therefrom to define a guiding wall on the guiding portion, a plurality of combing teeth transversely and spacedly extended along a bottom edge of the guiding wall, and a plurality of brush members upwardly and spacedly extended along each of the combing teeth for contacting with the hairs of the user. Therefore, when the colorant is applied on the brush members, the user is able to slide the combing teeth from a scalp of the user at a position slightly above roots of the hairs until ends of the hairs to guide the hairs of the user in 3-dimensionally contact with the brush members so as to evenly apply the colorant throughout the entire hairs.

7 Claims, 5 Drawing Sheets

HAIR COMBING APPARATUS FOR HAIR COLORING AND THE LIKE

CROSS REFERENCE OF RELATED APPLICATION

This is a regular application of a provisional application, application No. 60/468,968, filed May 9, 2003.

BACKGROUND OF THE PRESENT INVENTION

1. Field of Invention

The present invention relates to a hair comb, and more particularly to a hair combing apparatus for hair coloring and the like, wherein the combing teeth are transversely extended from the comb body to perpendicularly hold the bristles of the brush members in position in such a manner that the colorant on the bristles can 3-dimensionally contact with the hairs of the user so as to effectively and evenly apply the colorant on the user's hairs.

2. Description of Related Arts

Nowadays, there are hundreds of different brands of hair coloring have been sold in the drugstores such that people would like to color their hairs by themselves at home while being cost effective. Many hair coloring tools have been developed to help the users to color one's own hair easily.

In order to self-color theirs own hairs, the users usually use a brush to apply a colorant on the hairs and a comb to evenly spread out the colorant throughout each hair from its root to its tip. It is worth to mention that the roots of the hairs are spacedly growing on the scalp of the user while the hairs are bundled up together between the roots and the ends thereof. Therefore, it is difficult to evenly apply the colorant on the roots of the hairs.

Since the colorant contains chemical substances, the user has to carefully apply the colorant on the hairs to prevent the colorant contacts with the scalp of the user. However, it is difficult to practically use the brush to evenly apply on the hairs from the roots to the ends. As a result, a relatively large portion of the colorant will be stayed at the roots of the hairs and the ends thereof while a relatively small portion of the colorant is applied at the mid-portions of the hairs. In other words, uneven color intensity will be formed on the hairs.

In addition, it is impossible for the user to apply the colorant on the hairs via the brush by herself. Therefore, such conventional method of using the brush and the comb for hair coloring requires another individual for operation. In other words, the user cannot self-color her own hairs though the hair coloring operation.

An improved comb comprises a container formed thereon for containing the colorant wherein a plurality of channels are formed along the teeth of the comb to communicate with the container in such a manner that by applying a squeezing force on the container, the colorant is dislodged from the teeth of the comb through the channels. Therefore, the user is able to self-finish the hair coloring operation to apply the colorant on the hairs through the combing operation.

However, in order to apply the colorant at the roots of the hairs, the colorant may accidentally stay on the scalp of the user, which may damage the scalp of the user. Even though the user is able to squeeze the container to control the flow of the colorant dislodged from the teeth of the comb, the squeezing operation leads to different operational results depending with the squeezing force applied by the user. Therefore, such improved comb with the container is disadvantageous in practical use.

SUMMARY OF THE PRESENT INVENTION

A main object of the present invention is to provide a hair combing apparatus for hair coloring and the like, wherein the combing teeth are transversely extended from the comb body to perpendicularly hold the bristles of the brush members in position in such a manner that the colorant on the bristles can be 3-dimensionally contacted with the hairs of the user so as to effectively and evenly apply the colorant on the user's hairs.

Another object of the present invention is to provide a hair combing apparatus for hair coloring and the like, wherein the hair coloring operation is quick and simple that the user is able to comb his/her hairs via the hair combing apparatus.

Another object of the present invention is to provide a hair combing apparatus for hair coloring and the like, wherein the brush members are upwardly extended along the combing teeth in such a manner that when the combing teeth are slid on the scalp of the user, the colorant on the brush members will not contact with the scalp of the user so as to minimize the damage of the scalp of the user.

Another object of the present invention is to provide a hair combing apparatus for hair coloring and the like, wherein the comb body has a plurality of guiding through slots communicating with the combing teeth in such a manner that when the combing teeth are slid on the scalp of the user, the hairs are allowed to pass through the comb body through the guiding through slots so as to enhance the hair coloring operation of the present invention, especially for the user having long hairs.

Another object of the present invention is to provide a hair combing apparatus for hair coloring and the like, wherein no expensive or complicated structure is required to employ in the present invention in order to achieve the above mentioned objects. Therefore, the present invention successfully provides an economic and efficient solution not only for providing a hair coloring tool to effectively and evenly apply the colorant on the hairs but also for facilitating the practical use of the hair combing apparatus.

Accordingly, in order to accomplish the above objects, the present invention provides a hair combing apparatus for applying a colorant on a user's hairs, comprising:

an elongated comb body having a handle portion and a guiding portion extended from the handle portion to define a guiding wall on the guiding portion;

a plurality of combing teeth transversely and spacedly extended along a bottom edge of the guiding wall of the comb body; and a plurality of brush members upwardly and spacedly extended along each of the combing teeth for contacting with the hairs of the user;

thereby, when the colorant is applied on the brush members, the user is able to slide the combing teeth from a scalp of the user at a position slightly above roots of the hairs until tips of the hairs to guide the hairs of the user in 3-dimensionally contact with the brush members so as to evenly apply the colorant throughout the roots of the hairs to the ends thereof.

These and other objectives, features, and advantages of the present invention will become apparent from the following detailed description, the accompanying drawings, and the appended claims.

DETAILED DESCRIPTION OF THE PREFERRED EMBODIMENT

Figure 1:
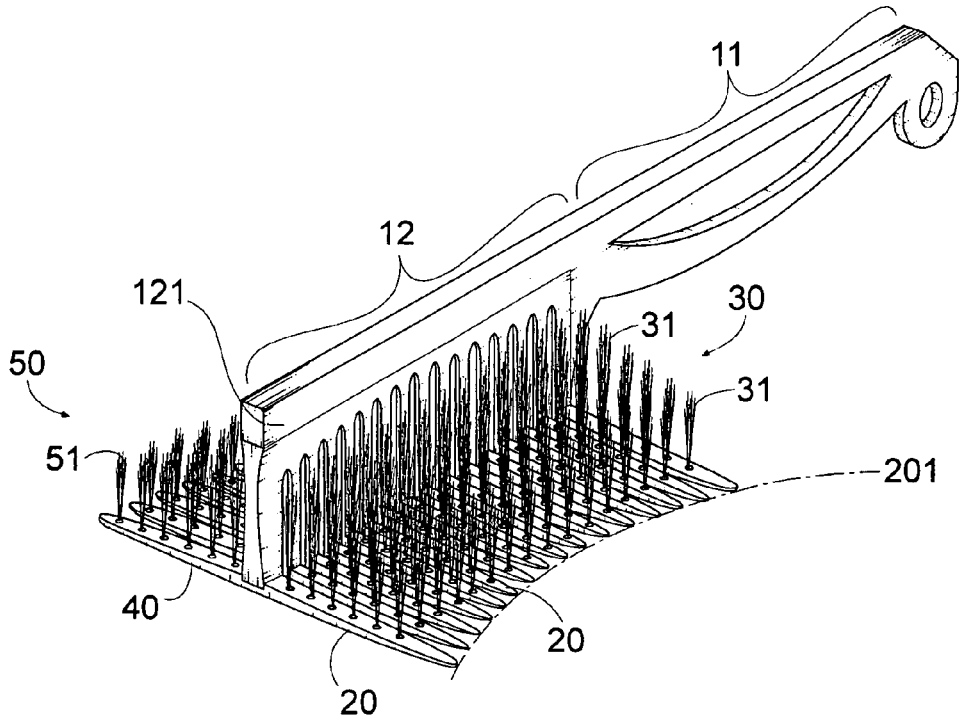
FIG. 1 is a perspective view of a hair combing apparatus for hair coloring and the like according to a preferred embodiment of the present invention.

Referring to FIG. 1 of the drawings, a hair combing apparatus for hair coloring and the like according to a preferred embodiment of the present invention is illustrated, wherein the hair combing apparatus, which is adapted for applying a colorant 1 on a user's hairs 2, comprises an elongated comb body 10 having a handle portion 11 and a guiding portion 12 extended from the handle portion 11 to define a guiding wall 121 on the guiding portion 12.

The hair combing apparatus further comprises a plurality of combing teeth 20 transversely and spacedly extended along a bottom edge of the guiding wall 121 of the comb body 12 and a plurality of brush members 30 upwardly and spacedly extended along each of the combing teeth 20 for contacting with the hairs 2 of the user.

According to the preferred embodiment, the comb body 10 is shaped and sized to have an elongated member wherein the handle portion 11 of the comb body 10 is defined at a rear portion of the comb body 10 and the guiding portion 12 is defined at a front portion of the comb body 10 in such a manner that the guiding wall 121 is formed on the guiding portion 12 of the comb body 10.

Figure 2:
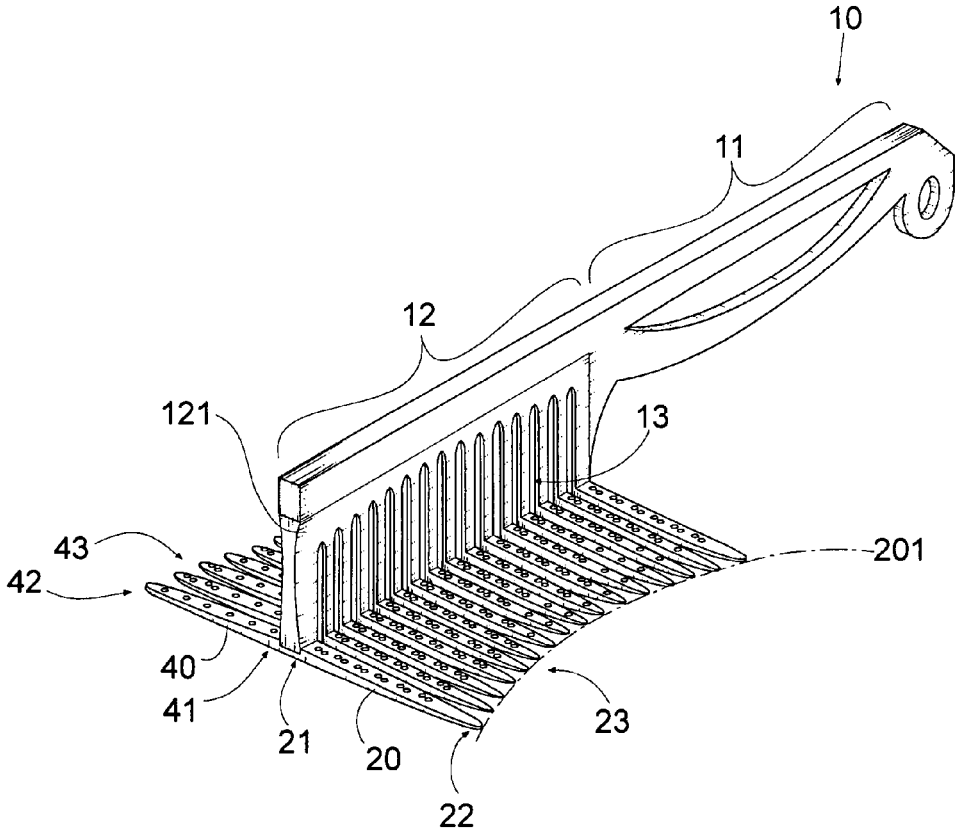
FIG. 2 is a perspective view of the hair combing apparatus without the brush members according to the above preferred embodiment of the present invention, illustrating the combing teeth communicating with the guiding through slots.
Figure 3:
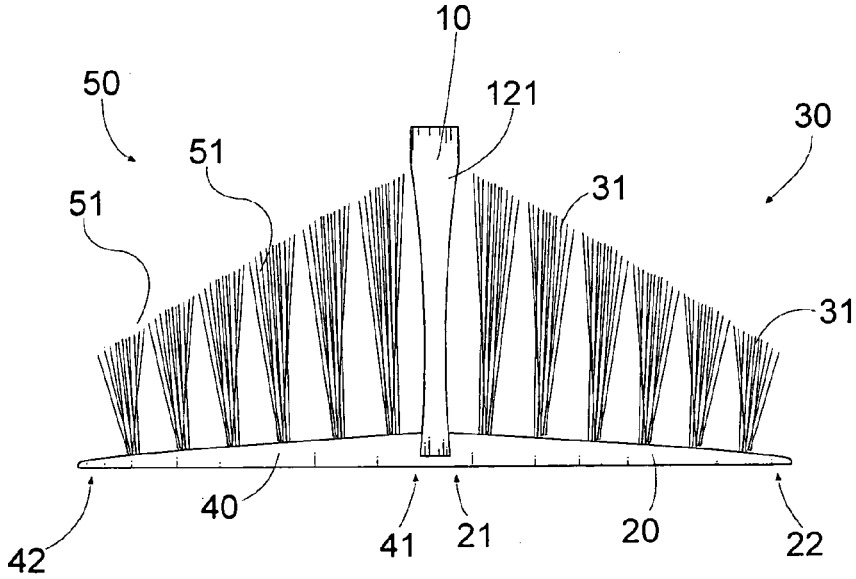
FIG. 3 is a front view of the hair combing apparatus for hair coloring and the like according to the above preferred embodiment of the present invention.

As shown in FIG. 2, each of the combing teeth 20 has an inner end 21 transversely extended from the bottom edge of the guiding wall 121 of the comb body 10 and a tapered outer end 22 adapted for efficiently guiding the respective combing tooth 20 to comb the hairs 2 of the user. As shown in FIG. 3, the combing teeth 20 are perpendicularly extended from the bottom edge of the guiding wall 121 of the comb 10 to form a L-shaped structure.

Each of the combing teeth 20 has a predetermined length wherein the combing teeth 20 are gradually increased with the lengths thereof at a direction from a middle of the guiding wall 121 to two ends thereof. Therefore, a curved contacting line 201 is formed by the outer ends 22 of the combing teeth 20 for contacting with the scalp 3 of the user. It is worth to mention that the scalp 3 of the user has a curvature in such a manner that the outer ends 22 of the combing teeth 20 are fittingly contacted with the scalp 3 of the user to guide the combing teeth 20 to comb the user's hairs 2.

A guiding groove 23 is defined between each two combing teeth 20 for guiding the hairs 2 of the user to slide from the outer ends 22 of the combing teeth 20 towards the inner ends 21 thereof, so as to guide the brush members 30 for contacting with the hairs 2 of the user.

The brush members 30 are spacedly extended along each of the combing teeth 20 from the inner end 21 to the outer end 22 thereof wherein each of the brush members 30 comprises a plurality of bristles 31 upwardly extended from the respective combing tooth 20 for enhancing a contacting area between the brush member 20 and the user's hairs 2. Accordingly, the bristles 31 are capable of holding the colorant 1 thereon such that when the bristles 31 are contacted with the user's hairs 2, the colorant 1 can be substantially applied on the user's hairs.

As shown in FIG. 3, each of the brush members 30 has a predetermined height wherein the brush members 30 gradually reduce their heights at a direction from the inner end 21 of the respective combing tooth 20 to the outer end 22 thereof. Therefore, when the combing teeth 20 slide on the user's hairs 2 at a direction from the outer ends 22 combing teeth 20 to the inner ends 21 thereof, the brush members 30 with the gradually increasing heights along the respective combing tooth 20 substantially contact with different portions of the user's hairs 2 so as to enhance the colorant 1 evenly applied on the user's hairs 2.

As shown in FIG. 2, the comb body 10 further has a plurality of guiding through slots 13 spacedly formed on the guiding portion 12 of the comb body 10 to align with the guiding grooves 23 respectively, wherein each of the guiding through slots 13 is formed on the guiding wall 121 at a position between each two combing teeth 20 to communicate with the respective guiding groove 23. Therefore, when the user's hairs are slid along the guiding grooves 23 to contact with the brush members 30 respectively, the user's hairs are guided to slide through the guiding wall 121 through the guiding through slots 13 respectively so as to enhance the hair coloring operation of the present invention.

The hair combing apparatus further comprises a plurality of additional combing teeth 40 transversely and spacedly extended along the bottom edge of the guiding wall 121 at a direction opposed to the combing teeth 20 and a plurality of additional brush members 50 upwardly and spacedly extended along each of the additional combing teeth 40 for contacting with the hairs 2 of the user.

According to the preferred embodiment, each of the additional combing teeth 40, which is shaped and sized as the combing tooth 20, has an inner end 41 transversely extended from the bottom edge of the guiding wall 121 of the comb body 10 and a tapered outer end 42 adapted for guiding the respective additional combing tooth 40 to comb the hairs 2 of the user. In addition, the additional combing teeth 40 gradually increase with their lengths at a direction from a middle of the guiding wall to two ends thereof.

An additional guiding groove 43 is defined between each two additional combing teeth 40 to communicate with the respective guiding groove 23 through the guiding through slot 13 of the guiding wall 121. Therefore, the user's hairs 2 are allowed to slidably pass through the guiding grooves 23 to the additional guiding grooves 43 through the guiding through slots 13 so as to contact with the brush members 30 and the additional brush members 50 respectively.

Each of the additional brush members 50, which is constructed as the brush members 30, comprises a plurality of additional bristles 51 upwardly extended from the respective additional combing tooth 40 for enhancing a contacting area between the additional brush member 50 and the user's hairs 2.

In other words, the addition combing teeth 40 and the additional brush members 50 are symmetrical to the combing teeth 40 and the brush members 30 respectively in such a manner that the user is able to use his or her right hand or left hand to operate the hair combing apparatus of the present invention to color his or her hairs. Furthermore, the brush members 30 and the addition brush members 50 respectively provided at two sides of the comb body 10 can increase the contacting area with the user's hairs 2 so as to effectively apply the colorant 1 on the user's hairs 2. As shown in FIG. 4B, the roots of user's hairs 2 are contacted with the brush members 30 while the tips of the user's hairs 2 are contacted with the additional brush members 50 so that the colorant 1 can be effectively applied on the entire hairs 2 of the user through the simple combing operation of the present invention.

Figure 4A:
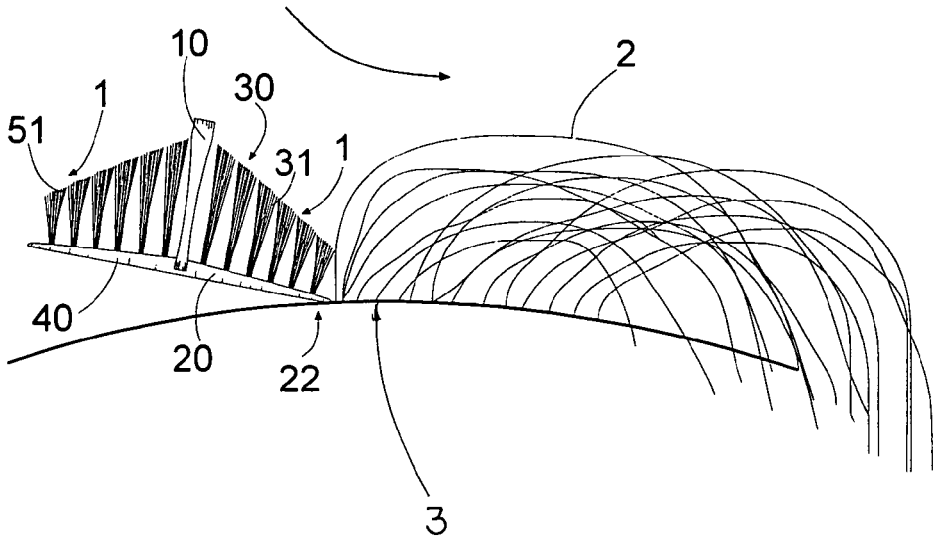
FIGS. 4A and 4B illustrate an hair coloring operation of the hair combing apparatus for hair coloring and the like according to the above preferred embodiment of the present invention.
Figure 4B:
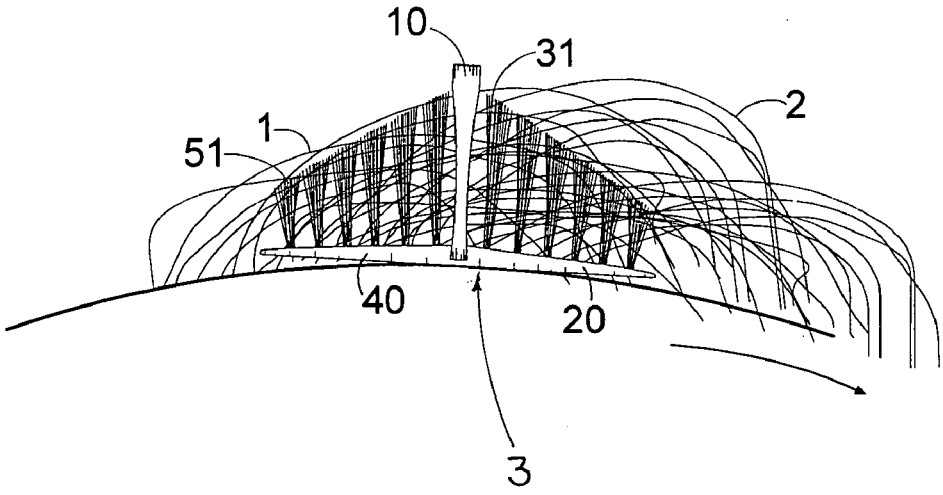

In order to operate the hair combing apparatus of the present invention, the user is able to hold the handle portion 11 of the comb body 10 to guide the outer ends 22 of the combing teeth 20 at the scalp of the user, as shown in FIG. 4A. By sliding the combing teeth 20 on the scalp of the user, the roots of the hairs are guided to slide along the guiding grooves 23 so as to contact with the brush members 30. Therefore, by continuously sliding combing teeth 20 along the user's hairs 2, as shown in FIG. 4B, the colorant 1 at the brush members 30 will evenly apply on the hairs 2 of the user from the roots to the ends thereof. For a lady user having a long hair, the combing teeth 20 will guide the hairs 2 of the user to slide to the additional combing teeth 40 through the guiding wall 121 to contact with the additional brush members 50 so as to provide a quick and easy operation for hair coloring, as shown in FIG. 4B.

It is worth to mention that the user's hairs not only are untangled by the combing teeth 20 during the combing operation but also 3-dimensionally contact with brush members 30 so that the colorant 1 can be evenly applied on the hairs 2 of the user from the roots to the ends thereof. Moreover, since only the combing teeth 30 are in contact with the scalp of the user, the colorant 1 at the brush members 30 will not contact with the scalp of the user, so as to prevent the damage of the scalp of the user due to the chemical substance of the colorant 1.

In view of above, the hair combing apparatus provide a unique L-shaped combing structure that the combing teeth 20 are transversely extended from the comb body 10 in such a manner that the combing teeth 20 can untangle the user's hairs 2 and guide the user's hairs 2 to contact with the brush members 30 while colorant 1 is prevented to stay on the scalp of the user.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A hair combing apparatus for applying a colorant on a user's hairs, comprising:

an elongated comb body having a handle portion and a guiding portion extended therefrom and comprising a guiding wall downwardly extended from said guiding portion, wherein said comb body further has a plurality of guiding through slots spacedly formed on said guiding portion of said comb body, a plurality of combing teeth transversely and spacedly extended along a bottom edge of said guiding wall of said comb body to form a L-shape structure, wherein each of said combing teeth has an outer end adapted for guiding said respective combing tooth to comb said user's hair, wherein each of said guiding through slots is formed on said guiding wall at a position between each two said combing teeth so as to communicate with a guiding groove defined between each two said combing teeth; and a plurality of brush members upwardly and spacedly extended along each of said combing teeth for contacting with said hairs of said user;

thereby, when said colorant is applied on said brush members, said user is able to slide said outer ends of said combing teeth from a scalp of said user at a position slightly above roots of said hairs until ends of said hairs to guide said user's hairs in 3-dimensionally contact with said brush members so as to evenly apply said colorant throughout said roots of said hairs to said ends thereof.

2. A hair combing apparatus for applying a colorant on a user's hairs, comprising:

an elongated comb body having a handle portion and a guiding portion extended therefrom and comprising a guiding wall downwardly extended from said guiding portion, wherein said comb body further has a plurality of guiding through slots spacedly formed on said guiding portion of said comb body, a plurality of combing teeth transversely and spacedly extended along a bottom edge of said guiding wall of said comb body to form a L-shape structure, wherein each of said combing teeth has an outer end adapted for guiding said respective combing tooth to comb said user's hair, wherein each of said guiding through slots is formed on said guiding wall at a position between each two said combing teeth so as to communicate with a guiding groove defined between each two said combing teeth, wherein each of said combing teeth has a predetermined length, wherein said combing teeth are gradually increased with said lengths thereof at a direction from a middle of said guiding wall to two ends thereof in such a manner that a curved contacting line is formed by said outer ends of said combing teeth for fittingly contacting with a curvature of a scalp of said user; and a plurality of brush members upwardly and spacedly extended along each of said combing teeth for contacting with said hairs of said user;

thereby, when said colorant is applied on said brush members, said user is able to slide said outer ends of said combing teeth from said scalp of said user at a position slightly above roots of said hairs until ends of said hairs to guide said user's hairs in 3-dimensionally contact with said brush members so as to evenly apply said colorant throughout said roots of said hairs to said ends thereof.

3. A hair combing apparatus for applying a colorant on a user s hairs, comprising:

an elongated comb body having a handle portion and a guiding portion extended therefrom and comprising a guiding wall downwardly extended from said guiding portion, wherein said comb body further has a plurality of guiding through slots spacedly formed on said guiding portion of said comb body, a plurality of combing teeth transversely and spacedly extended along a bottom edge of said guiding wall of said comb body to form a L-shape structure, wherein each of said combing teeth has an outer end adapted for guiding said respective combing tooth to comb said user's hair, wherein each of said guiding through slots is formed on said guiding wall at a position between each two said combing teeth so as to communicate with a guiding groove defined between each two said combing teeth, wherein each of said combing teeth has a predetermined length, wherein said combing teeth are gradually increased with said lengths thereof at a direction from a middle of said guiding wall to two ends thereof in such a manner that a curved contacting line is formed by said outer ends of said combing teeth for fittingly contacting with a curvature of a scalp of said user, wherein each said outer end of said combing teeth is shaped to have a tapered shape adapted for efficiently guiding said respective combing tooth to comb said user's hairs; and a plurality of brush members upwardly and spacedly extended along each of said combing teeth for contacting with said hairs of said user, wherein each of said brush members has a predetermined height, wherein said brush members are gradually reduced said heights thereof at a direction from an inner end of said respective combing tooth to said outer end thereof;

thereby, when said colorant is applied on said brush members, said user is able to slide said outer ends of said combing teeth from said scalp of said user at a position slightly above roots of said hairs until ends of said hairs to guide said user's hairs in 3-dimensionally contact with said brush members so as to evenly apply said colorant throughout said roots of said hairs to said ends thereof.

4. A hair combing apparatus for applying a colorant on a user's hairs, comprising:

an elongated comb body having a handle portion and a guiding portion extended therefrom and comprising a guiding wall downwardly extended from said guiding portion, wherein said comb body further has a plurality of guiding through slots spacedly formed on said guiding portion of said comb body, a plurality of combing teeth transversely and spacedly extended along a bottom edge of said guiding wall of said comb body to form a L-shape structure, wherein each of said combing teeth has an outer end adapted for guiding said respective combing tooth to comb said user's hair, wherein each of said guiding through slots is formed on said guiding wall at a position between each two said combing teeth so as to communicate with a guiding groove defined between each two said combing teeth, wherein each of said combing teeth has a predetermined length, wherein said combing teeth are gradually increased with said lengths thereof at a direction from a middle of said guiding wall to two ends thereof in such a manner that a curved contacting line is formed by said outer ends of said combing teeth for fittingly contacting with a curvature of a scalp of said user, wherein each said outer end of said combing teeth is shaped to have a tapered shape adapted for efficiently guiding said respective combing tooth to comb said user's hairs; and a plurality of brush members upwardly and spacedly extended along each of said combing teeth for contacting with said hairs of said user, wherein each of said brush members has a predetermined height, wherein said brush members are gradually reduced said heights thereof at a direction from an inner end of said respective combing tooth to said outer end thereof, wherein each of said brush members comprises a plurality of bristles upwardly extended from said respective combing tooth for enhancing a contacting area between said respective brush member and said user's hairs;

thereby, when said colorant is applied on said brush members, said user is able to slide said outer ends of said combing teeth from said scalp of said user at a position slightly above roots of said hairs until ends of said hairs to guide said user's hairs in 3-dimensionally contact with said brush members so as to evenly apply said colorant throughout said roots of said hairs to said ends thereof.

5. The hair combing apparatus, as recited in claim 4, wherein each of said combing teeth is perpendicularly extended from said bottom edge of said guiding wall of said comb body to form said L-shaped structure.

6. The hair combing apparatus, as recited in claim 5, further comprising a plurality of additional combing teeth transversely and spacedly extended along said bottom edge of said guiding wall at a direction opposed to said combing teeth and a plurality of additional brush members upwardly and spacedly extended along each of said additional combing teeth, wherein said addition combing teeth and said additional brush members are symmetrical to said combing teeth and said brush members respectively.

7. The hair combing apparatus, as recited in claim 4, further comprising a plurality of additional combing teeth transversely and spacedly extended along said bottom edge of said guiding wall at a direction opposed to said combing teeth and a plurality of additional brush members upwardly and spacedly extended along each of said additional combing teeth, wherein said addition combing teeth and said additional brush members are symmetrical to said combing teeth and said brush members respectively.

* * * * *